US006988471B2

(12) United States Patent
Chang

(10) Patent No.: US 6,988,471 B2
(45) Date of Patent: Jan. 24, 2006

(54) ENGINE VALVE ACTUATION SYSTEM

(75) Inventor: David Yu-Zhang Chang, Lawrenceville, GA (US)

(73) Assignee: Caterpillar Inc, Peoria, IL (US)

( * ) Notice: Subject to any disclaimer, the term of this patent is extended or adjusted under 35 U.S.C. 154(b) by 110 days.

(21) Appl. No.: 10/743,000

(22) Filed: Dec. 23, 2003

(65) Prior Publication Data

US 2005/0132986 A1 Jun. 23, 2005

(51) Int. Cl.
*F01L 9/02* (2006.01)

(52) U.S. Cl. ..... 123/90.12; 123/90.15; 123/198 F; 91/407; 91/408

(58) Field of Classification Search ..... 123/90.12, 123/90.15, 90.16, 90.49, 90.52, 90.55, 90.57, 123/188.8, 198 F; 91/407–409
See application file for complete search history.

(56) References Cited

U.S. PATENT DOCUMENTS

| | | | | |
|---|---|---|---|---|
| 3,250,068 A | | 5/1966 | Vulliamy | |
| 4,065,094 A | | 12/1977 | Adams | |
| 4,150,640 A | | 4/1979 | Egan | |
| 4,211,107 A | | 7/1980 | Sleeter et al. | |
| 4,296,911 A | | 10/1981 | Escobosa | |
| 4,424,790 A | | 1/1984 | Curtil | |
| 4,561,253 A | | 12/1985 | Curtil | |
| 4,794,892 A | | 1/1989 | Konno | |
| 4,815,423 A | | 3/1989 | Holmer | |
| 4,869,222 A | | 9/1989 | Klassen | |
| 5,000,145 A | * | 3/1991 | Quenneville | 123/321 |
| 5,408,979 A | | 4/1995 | Backlund et al. | |
| 5,421,359 A | | 6/1995 | Meister et al. | |
| 5,445,128 A | | 8/1995 | Letang et al. | |
| 5,460,131 A | | 10/1995 | Usko | |
| 5,462,025 A | * | 10/1995 | Israel et al. | 123/321 |
| 5,531,192 A | * | 7/1996 | Feucht et al. | 123/90.12 |
| 5,537,976 A | * | 7/1996 | Hu | 123/322 |

(Continued)

FOREIGN PATENT DOCUMENTS

JP 05106415 A2 4/1993

(Continued)

OTHER PUBLICATIONS

Edwards et al., "The Potential of a Combined Miller Cycle and Internal EGR Engine for Future Heavy Duty Truck Applications," The Engineering Society for Advancing Mobility Land Sea Air and Space International, International Congress and Exposition, Feb. 23-26, 1998, pp. 1-19.

(Continued)

*Primary Examiner*—Thomas Denion
*Assistant Examiner*—Kyle M. Riddle
(74) *Attorney, Agent, or Firm*—Finnegan, Henderson, Farabow, Garrett & Dunner

(57) ABSTRACT

An engine valve actuation system includes an engine valve moveable between first and second positions, a valve actuation assembly connected to move the engine valve between the first and second positions, a fluid actuator configured to selectively modify a timing of the engine valve in moving from the second to the first position, a source of fluid, and a pair of passages in the cylinder that allow fluid to flow from the chamber to the fluid source. The fluid actuator includes a cylinder and a piston at least partly defining a chamber. The piston is slidably movable in the cylinder between a first position and a second position, and blocks at least a portion of one of the passages at an intermediate position between the second position and the first position to reduce fluid flow from the chamber when the piston moves from the second position toward the first position.

59 Claims, 2 Drawing Sheets

U.S. PATENT DOCUMENTS

| | | | | |
|---|---|---|---|---|
| 5,576,963 | A | 11/1996 | Ribbens et al. | |
| 5,577,468 | A | 11/1996 | Weber | |
| 5,606,940 | A | 3/1997 | Shafer et al. | |
| 5,682,854 | A | 11/1997 | Ozawa | |
| 5,692,464 | A | 12/1997 | Kimura | |
| 5,927,075 | A | 7/1999 | Khair | |
| 5,983,863 | A | 11/1999 | Cavanagh et al. | |
| 5,996,550 | A * | 12/1999 | Israel et al. | 123/322 |
| 6,006,706 | A | 12/1999 | Kanzaki | |
| 6,021,758 | A | 2/2000 | Carey et al. | |
| 6,026,786 | A | 2/2000 | Groff et al. | |
| 6,067,946 | A | 5/2000 | Bunker et al. | |
| 6,082,328 | A | 7/2000 | Meistrick et al. | |
| 6,170,441 | B1 | 1/2001 | Haldeman et al. | |
| 6,192,841 | B1 | 2/2001 | Vorih et al. | |
| 6,209,516 | B1 | 4/2001 | Yamashita | |
| 6,237,551 | B1 | 5/2001 | Macor et al. | |
| 6,267,107 | B1 | 7/2001 | Ward | |
| 6,273,076 | B1 | 8/2001 | Beck et al. | |
| 6,279,550 | B1 | 8/2001 | Bryant | |
| 6,301,887 | B1 | 10/2001 | Gorel et al. | |
| 6,301,889 | B1 | 10/2001 | Gladden et al. | |
| 6,302,076 | B1 | 10/2001 | Bredy | |
| 6,302,370 | B1 | 10/2001 | Schwoerer et al. | |
| 6,412,457 | B1 * | 7/2002 | Vorih et al. | 123/90.12 |
| 6,467,452 | B1 | 10/2002 | Duffy et al. | |
| 6,474,277 | B1 | 11/2002 | Vanderpoel et al. | |
| 6,550,433 | B2 | 4/2003 | Vorih et al. | |
| 6,571,765 | B2 | 6/2003 | Kuboshima et al. | |
| 6,651,601 | B2 | 11/2003 | Sun et al. | |
| 6,651,618 | B1 | 11/2003 | Coleman et al. | |
| 6,688,280 | B2 | 2/2004 | Weber et al. | |
| 6,769,385 | B1 * | 8/2004 | Chang | 123/90.16 |
| 6,772,742 | B2 | 8/2004 | Lei et al. | |
| 2003/0164163 | A1 | 9/2003 | Lei et al. | |
| 2003/0183185 | A1 | 10/2003 | Sun et al. | |

FOREIGN PATENT DOCUMENTS

| | | | |
|---|---|---|---|
| JP | 2000120457 | A | 4/2000 |
| JP | 2000145484 | A | 5/2000 |
| WO | WO 98/02653 | | 1/1998 |

OTHER PUBLICATIONS

Obert, "Internal Combustion Engines and Air Pollution," Based on Internal Combustion Engines, Third Edition, 1973, pp. 612-614.

Challen et al., "Diesel Engine Reference Book, Section Edition," SAE International, 1999, pp. 75, 81, 84, 146, and 263-305.

Yorihiro Fukuzawa et al., "Development of High Efficiency Miller Cycle Gas Engine", Mitsubishi Heavy Industries, Ltd., Technical Review, vol. 38, No. 3, Oct. 2001, pp. 146-150.

Request for *Inter Partes* Reexamination Transmittal Form for U.S. Pat. 6,688,280, and Attachment to Request for Inter Parties Reexamination Transmittal Form, Sep. 17, 2004.

Request for *Inter Partes* Reexamination Transmittal Form for U.S. Pat. 6,651,618, and Attachment to Request for Inter Parties Reexamination Transmittal Form, Aug. 27, 2004.

http://www.mazda.com.au/corpora/209.html, Oct. 16, 2001, p. 1-6.

Specification for U.S. Appl. No. 10/309,312, Engine Valve Actuation System, filed Dec. 4, 2002.

U.S. Patent and Trademark Office Action for U.S. Appl. No. 10/309,312, mailed Dec. 2, 2004.

U.S. Patent and Trademark Office Action for U.S. Appl. No. 10/309,312, mailed Jul. 26, 2004.

U.S. Patent and Trademark Office Action for U.S. Appl. No. 10/309,312, mailed Feb. 24, 2004.

* cited by examiner

ENGINE VALVE ACTUATION SYSTEM

TECHNICAL FIELD

The present invention is directed to a variable valve actuation system. More particularly, the present invention is directed to a variable valve actuation system for an internal combustion engine.

BACKGROUND

The operation of an internal combustion engine, such as, for example, a diesel, gasoline, or natural gas engine, may cause the generation of undesirable emissions. These emissions, which may include particulates and nitrous oxide (NOx), are generated when fuel is combusted in a combustion chamber of the engine. An exhaust stroke of an engine piston forces exhaust gas, which may include these emissions, from the engine. If no emission reduction measures are in place, these undesirable emissions will eventually be exhausted to the environment.

Reduced internal combustion engine exhaust gas emissions and improved engine performance of an engine may be achieved by adjusting the actuation timing of the engine valves. For example, the actuation timing of the intake and exhaust valves may be modified to implement a variation on the typical diesel cycle or Otto cycle known as the Miller cycle. In a "late intake" type Miller cycle, the intake valves of the engine are held open during a portion of the compression stroke of the piston.

Engines implementing a late intake Miller cycle may include a fluid actuator capable of varying the closing timing of mechanically operated intake valves. In such systems, the fluid actuator may experience impact forces against an actuator chamber wall associated with the closing of the intake valves by the stiff return springs. Consequently, the fluid actuator may suffer erosion, fracture, and/or breakage.

U.S. Pat. No. 5,577,468 discloses an engine having a snubbing assembly for reducing the flow of fluid from the fluid actuator, and thereby reduce the intake valve seating velocity. However, in that engine, the piston of the fluid actuator and the snubbing assembly are implemented separately from one another, thus requiring independent manufacture of multiple components at tight tolerances, complicating assembly and repair/replacement, and occupying valuable space in the engine compartment, all of which may result in increased costs to the manufacturer.

The variable valve actuation system of the present invention solves one or more of the problems set forth above.

SUMMARY OF THE INVENTION

In one aspect, the present invention is directed to an engine valve actuation system that includes an engine valve moveable between a first position that blocks a flow of fluid and a second position that allows a flow of fluid. The system also includes a valve actuation assembly operably connected to move the engine valve between the first position and the second position, and a fluid actuator configured to selectively modify a timing of the engine valve in moving from the second position to the first position. The fluid actuator includes a cylinder and a piston cooperating to at least partly define a chamber, and the piston is slidably movable in the cylinder between a first position and a second position. The system also includes a source of fluid in communication with the fluid actuator and a pair of passages in the cylinder. The passages are structured and arranged to allow fluid to flow from the chamber to the source of fluid at a time when the piston is moving from the second position toward the first position. The piston blocks at least a portion of one of the passages at an intermediate position between the second position and the first position so as to reduce the flow of fluid from the chamber at a time when the piston is moving from the second position toward the first position.

In another aspect, the present invention is directed to a method of operating an engine valve actuation system. The method includes moving an engine valve, according to a desired timing, between a first position that blocks a flow of fluid and a second position that allows a flow of fluid. The method also includes directing fluid flow between a source of fluid and a chamber of a fluid actuator to slideably move an actuator piston in an actuator cylinder between a first position and an second position, and operatively engaging the fluid actuator with the engine valve when the piston is in the second position to modify the timing of moving the engine valve from the second position to the first position. In addition, the method includes passing fluid from the chamber to the source of fluid at a first rate at a time when the piston is moving from the second position toward the first position, and throttling the passing of fluid from the chamber to a second rate less than the first rate by blocking a fluid passage from the chamber with the piston at a time when the piston is moving from the second position toward the first position.

In yet another aspect, the present invention is directed to an engine valve actuation system including an engine valve moveable between a first position that blocks a flow of fluid and a second position that allows a flow of fluid. The system includes a valve actuation assembly operably connected to move the engine valve between the first position and the second position, a fluid actuator configured to selectively modify a timing of the engine valve in moving from the second position to the first position, and a source of fluid in fluid communication with the fluid actuator. The fluid actuator includes a cylinder, a piston, and a chamber, wherein the cylinder includes a snubbing orifice and at least one radial passage, and the piston is slidably movable in the cylinder between a first position and a second position. The source of fluid is in fluid communication with the chamber via the snubbing orifice and the at least one radial passage when the piston moves from the first position toward the second position, and fluid flow through the at least one radial passage is prevented during at least a portion of movement of the piston from the second position toward the first position.

DETAILED DESCRIPTION

Figure 1:
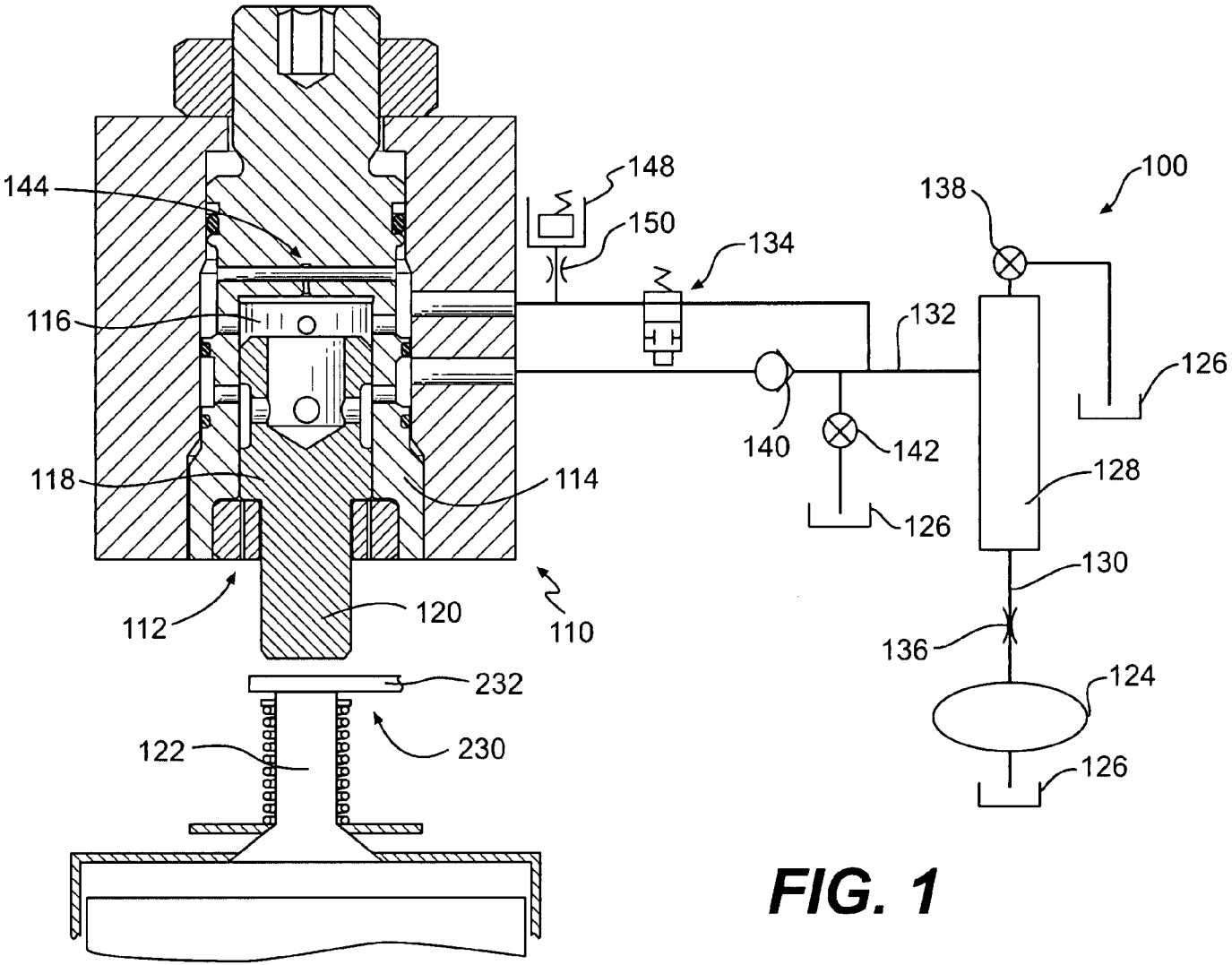
FIG. 1 is a schematic and diagrammatic representation of an engine valve actuation system in accordance with an exemplary embodiment of the present invention.

An exemplary embodiment of an engine valve actuation system 100 is illustrated in FIG. 1. The valve actuation system 100 may include at least one valve actuation assembly 230 and at least one corresponding variable valve assembly 110. The variable valve assembly 110 includes a fluid actuator 112, which includes an actuator cylinder 114 that defines an actuator chamber 116. An actuator piston 118 is slidably disposed in the actuator cylinder 114 and is connected to an actuator rod 120.

The actuator rod 120 is operably associated with an engine valve 122, for example, either an intake valve or an exhaust valve. The actuator rod 120 may be directly engageable with the valve 122 or indirectly engageable via the valve actuation assembly 230. The valve actuation assembly 230 may include a pivotable rocker arm 232 or any other valve actuator known in the art. For example, one skilled in the art would recognize that the rocker arm 232 may be mechanically coupled to a cam assembly (not shown), which may be drivingly connected to a crankshaft (not shown).

As illustrated in FIG. 1, the system 100 may include a source of fluid 124 fluidly coupled to a tank 126 and arranged to supply pressurized fluid to a series of fluid actuators 112, only one of which is illustrated for purposes of clarity. Each fluid actuator 112 may be associated with an engine valve 122, for example, an intake valve or an exhaust valve of a particular engine cylinder 214 (referring to FIG. 2). The tank 126 may store any type of fluid readily apparent to one skilled in the art, such as, for example, hydraulic fluid, fuel, or transmission fluid. The source of fluid 124 may be part of a lubrication system, sometimes referred to as a main gallery, such as typically accompanies an internal combustion engine. Such a lubrication system may provide pressurized oil having a pressure of, for example, less than 700 KPa (100 psi) or, more particularly, between about 210 KPa and 620 KPa (30 psi and 90 psi). Alternatively, the source of fluid 124 may be a pump configured to provide oil at a higher pressure, such as, for example, between about 10 MPa and 35 MPa (1450 psi and 5000 psi).

In the exemplary embodiment of FIG. 1, the source of fluid 124 is connected to a fluid rail 128 through a first fluid line 130. A second fluid line 132 may direct pressurized fluid from the fluid rail 128 toward the actuator chamber 116 of the fluid actuator 112. A directional control valve 134 may be disposed in the second fluid line 132. The directional control valve 134 may be opened to allow pressurized fluid to flow between the fluid rail 128 and the actuator chamber 116. The directional control valve 134 may be closed to prevent pressurized fluid from flowing between the fluid rail 128 and the actuator chamber 116. The directional control valve 134 may be normally biased into a closed position and actuated to allow fluid to flow through the directional control valve 134. Alternatively, the directional control valve 134 may be normally biased into an open position and actuated to prevent fluid from flowing through the directional control valve 134. One skilled in the art will recognize that the directional control valve 134 may be any type of controllable valve, such as, for example a two coil latching valve.

One skilled in the art will recognize that the variable valve assembly 110 may have a variety of different configurations. For example, as illustrated in FIG. 1, an optional restrictive orifice 136 may be positioned in the fluid line 130 between the source of fluid 124 and a first end of the fluid rail 128. A control valve 138 may be connected to an opposite end of the fluid rail 128 and lead to the tank 126. The control valve 138 may be opened to allow a flow of fluid through the restrictive orifice 136 and the fluid rail 128 to the tank 126. The control valve 138 may be closed to allow a build up of pressure in the fluid within the fluid rail 128.

In addition, as shown in FIG. 1, the variable valve assembly 110 may include a check valve 140 placed in parallel with the directional control valve 134 between the source of fluid 124 and the fluid actuator 112. The check valve 140 may be configured to allow fluid to flow in the direction from the source of fluid 124 toward the fluid actuator 112 and to provide a make-up function. The check valve 140 may be, for example, a poppet-type check valve, a plate-type check valve, a ball-type check valve, or the like.

As also shown in FIG. 1, the variable valve assembly 110 may optionally include an air bleed valve 142. The air bleed valve 142 may be any device readily apparent to one skilled in the art as capable of allowing air to escape a hydraulic system. For example, the air bleed valve 142 may be an air bleed orifice or a spring-biased ball valve that allows air to flow through the valve, but closes when exposed to fluid pressure.

In addition, a snubbing assembly 144 may be in fluid communication with the directional control valve 134, the check valve 140, and the actuator chamber 116. The snubbing assembly 144 may be configured to restrict the flow of fluid from the actuator 116, as will be described more fully below with respect to FIG. 2. For example, the snubbing assembly 144 may be configured to decrease the rate at which fluid exits the actuator chamber 116 to thereby slow the rate at which the engine valve 122 closes.

The variable valve assembly 110 may also include an accumulator 148 and a restrictive orifice 150, as illustrated in FIG. 1. The combination of the accumulator 148 and the restrictive orifice 150 may act to dampen pressure oscillations in the actuator chamber 116, which may cause the actuator piston 118 to oscillate.

Figure 2:
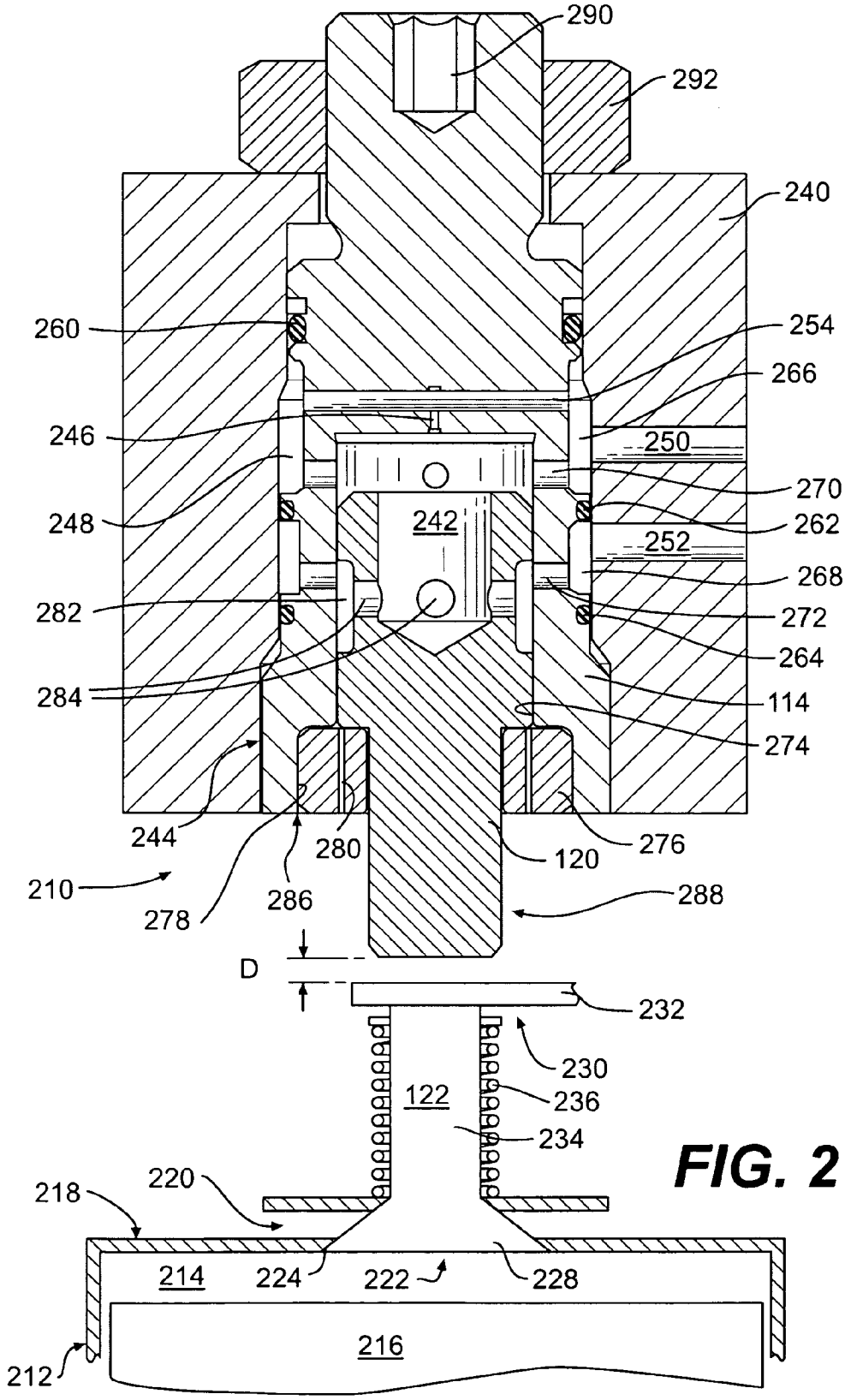
FIG. 2 is a diagrammatic cross-sectional view of a variable valve assembly in accordance with an exemplary embodiment of the present invention.

Referring now to FIG. 2, an engine 210, for example, a four-stroke diesel engine, includes an engine block 212 that defines a plurality of cylinders 214, only one of which is shown for purposes of clarity. A piston 216 is slidably disposed within each cylinder 214, the sliding motion of the piston 216 being the product of a mechanically-coupled crankshaft (not shown). The engine 210 may include six cylinders and six associated pistons. One skilled in the art will readily recognize that the engine 210 may include a greater or lesser number of pistons and that the pistons may be disposed in an "in-line" configuration, a "V" configuration, or any other conventional configuration. One skilled in the art will also recognize that the engine 210 may be any other type of internal combustion engine, such as, for example, a gasoline or natural gas engine.

As illustrated in FIG. 2, the engine 210 also includes a cylinder head 218 defining an intake passageway 220 that leads to at least one intake port 222 for each cylinder 214. The cylinder head 218 may further define two or more intake ports 222 for each cylinder 214. Each intake port 222 includes a valve seat 224. One intake valve 122 is disposed within each intake port 222. Each intake valve 122 includes a valve element 228 controllable to alternatively engage and disengage the valve seat 224. When the intake valve 122 is in a closed position, the valve element 228 engages the valve seat 224 to close the intake port 222 and block fluid flow relative to the cylinder 214. Each intake valve 122 may be operated to move or "lift" the valve element 228 away from the valve seat 224 to thereby open the respective intake port 222. When the intake valve 122 is lifted from the closed position, the intake valve 122 allows a flow of fluid relative to the cylinder 214. In a cylinder 214 having a pair of intake ports 222 and a pair of intake valves 224, the pair of intake valves 224 may be actuated by a single valve actuation assembly or by a pair of valve actuation assemblies.

As also shown in the exemplary embodiment of FIG. 2, the valve actuation assembly 230 is operatively associated with the intake valve 122. The valve actuation assembly 230 may include the rocker arm 232 connected to the valve element 228 through a valve stem 234. A spring 236 may be disposed around the valve stem 234 between the cylinder head 218 and the rocker arm 232. The spring 236 acts to bias the valve element 228 into engagement with the valve seat 224 to thereby close the intake port 222. It should be appreciated that a similar valve actuation assembly may be connected to the exhaust valves (not shown) of the engine 210.

As shown in FIG. 2, the actuator chamber 116 of the variable valve assembly 110 may include a cavity 242 extending longitudinally into the actuator piston 118 from the end of the piston 118 opposite the actuator rod 120. The piston 118 is assembled into the actuator cylinder 114, which in turn may be disposed in a housing 240. The actuator cylinder 114 may be coupled to the housing 240, for example, via a threaded coupling 244. The snubbing assembly 144 may include a snubbing orifice 246, the actuator cylinder 114, and the actuator piston 118.

The actuator piston 118 may be slidably received in a first bore 274 of the actuator cylinder 114. The diametrical clearance between the actuator piston 118 and the first bore 274 may be minimized to prevent significant leakage of hydraulic fluid through this clearance. The piston 118 and cylinder 114 may cooperate to define an annular cavity 282 therebetween. The first bore 274 may be fluidly connected with the annular cavity 282 via one or more radial passages 284 extending through the piston 118.

A stop plate 276 may be received in a second bore 278 of the actuator cylinder 114. The first bore 274 extends axially inward from and may have a smaller diameter than the second bore 278. The stop plate 276 may be coupled to the actuator cylinder 114, for example, via a threaded coupling 286 between a periphery of the stop plate 276 and an interior of the actuator cylinder 114. Thus, the stop plate 276 may prevent the actuator piston 118 from falling out of the actuator cylinder 114, and provide a stop position for travel of the actuator piston 118. The stop plate 276 may also include one or more drain passages 280 that allow leaked fluid to return to the tank 126 in order to prevent hydraulic lock of the variable valve assembly 110.

First and second flow passages 250, 252 through the housing 240 may provide fluid communication between the source of fluid 124 and an interior 248 of the housing 240. First, second, and third O-rings 260, 262, 264 may be disposed about the actuator cylinder 114. The O-rings 260, 262, 264 may cooperate with the cylinder 114 and housing 240 to define first and second sealed annular cavities 266, 268. The first flow passage 250 may provide fluid directed by the directional control valve 134 to the first sealed annular cavity 266 of the housing 240, and the second flow passage 252 may provide fluid through check valve 140 to the second sealed annular cavity 268.

The first sealed annular cavity 266 may be in fluid communication with the cavity 242 via one or more transverse flow passages 254 through the actuator cylinder 114 and the snubbing orifice 246. The first sealed annular cavity 266 may also be in fluid communication with the cavity 242 via one or more radial passages 270 through the cylinder 114. The second sealed annular cavity 268 may be in fluid communication with the cavity 242 via one or more additional radial passages 272 through the cylinder 114 and the radial passages 284 through the actuator piston 118.

The actuator rod 120 of the actuation piston 118 may operatively interface with the intake valve 122, for example, either directly or via the valve actuation assembly 230. A desired lash D between a free end 288 of the actuator rod 120 and the rocker arm 232 can be achieved by turning the actuator cylinder 114 in or out via an adjustment member 290, for example, an internal hex. When the lash D is adjusted to the desired amount, the actuator cylinder may be locked in place, for example, with a nut 292.

It should be appreciated that the engine valve actuation system 100 may include a controller (not shown) electrically coupled to one or more of the aforementioned elements of the system. The controller may include an electronic control module that has a microprocessor and a memory. As is known to those skilled in the art, the memory is connected to the microprocessor and stores an instruction set and variables. Associated with the microprocessor and part of electronic control module are various other known circuits such as, for example, power supply circuitry, signal conditioning circuitry, and solenoid driver circuitry, among others.

The controller may be programmed to control one or more aspects of the operation of the engine 210. For example, the controller may be programmed to control the variable valve assembly, the fuel injection system (not shown), and any other function readily apparent to one skilled in the art. The controller may control the engine 210 based on the current operating conditions of the engine and/or instructions received from an operator.

The controller may be further programmed to receive information from one or more sensors (not shown) operatively connected with the engine 210. Each of the sensors may be configured to sense one or more operational parameters of the engine 210. For example, the engine 210 may be equipped with sensors configured to sense one or more of the following: hydraulic fluid temperature, the temperature of the engine coolant, the temperature of the engine, the ambient air temperature, the engine speed, the load on the engine, the intake air pressure, and the crank angle of the engine crankshaft (not shown).

INDUSTRIAL APPLICABILITY

Based on information provided by engine sensors and a controller, the variable valve assembly 110 may be operated to modify normal valve operation by selectively implementing a late intake Miller cycle for each cylinder 214 of the engine 210. Under normal operating conditions, implementation of the late intake Miller cycle will increase the overall efficiency of the engine 210. Under some operating conditions, such as, for example, when the engine 210 is cold, the engine 210 may be operated on a conventional diesel cycle. The described engine valve actuation system 100 allows for the selective engagement and disengagement of the late intake Miller cycle.

The following discussion describes the implementation of a late intake Miller cycle in a single cylinder 214 of the engine 210. One skilled in the art will recognize that the system of the present invention may be used to selectively implement a late intake Miller cycle in all cylinders of the engine 210 in the same or a similar manner. In addition, the system of the present invention may be used to implement other valve actuation variations on the conventional diesel cycle, such as, for example, an exhaust Miller cycle.

When the engine 210 is operating under normal operating conditions, a late intake Miller cycle may be implemented by selectively actuating the fluid actuator 112 to hold the intake valve 122 open for a first portion of the compression stroke of the piston 216. This may be accomplished by closing the control valve 138, allowing fluid pressure to build in the fluid rail 128. The directional control valve 134 is then moved to the open position when the piston 216 starts an intake stroke, allowing pressurized fluid to flow from the source of fluid 124 through the fluid rail 128 and into the actuator chamber 116. The force of the fluid entering the actuator chamber 116 moves the actuator piston 118 so that the actuator rod 120 follows the rocker arm 232 as the rocker arm 232 pivots to open the intake valve 122.

When the actuator chamber 116 is filled with fluid and the rocker arm 232 allows the intake valve 122 to move from the open position to the closed position, the actuator rod 120 may engage the rocker arm 232 and keep the valve element 228 lifted from the valve seat 224. Pressurized fluid may flow through both the directional control valve 134 and the check valve 140 into the actuator chamber 116. Alternatively, the directional control valve 134 may remain in a closed position and fluid may flow through the check valve 140 into the actuator chamber 116.

When the actuator chamber 116 is filled with fluid, the directional control valve 134 may be closed to prevent fluid from escaping from the actuator chamber 116. As long as the directional control valve 134 remains in the closed position, the trapped fluid in the actuator chamber 116 will prevent the spring 236 from returning the intake valve 122 to the closed position. Thus, the fluid actuator 112 will hold the intake valve 122 in an open position, for example, at least a partially open position, independent of the valve actuation assembly 230.

For example, during operation of the engine 210, hydraulic fluid is supplied from the source of fluid 124 to the annular cavity 282 via at lease one of the first and second flow passages 250, 252. The first sealed annular cavity 266 distributes the hydraulic fluid through the radial passages 270 into the cavity 242 and through the transverse flow passage 254 and the snubbing orifice 246 into the cavity 242. The second sealed annular cavity 268 supplies hydraulic fluid to the cavity 242 via the additional radial passages 272. The hydraulic fluid flowing to the cavity 242 urges the actuator piston and rod 118, 120 to follow the motion of the intake valve 122 as the intake valve is lifted by the valve actuation assembly 230. The actuator piston 118 is urged by the hydraulic fluid until the piston 118 engages the stop plate 276.

Since an opening stroke length of the engine intake valve 122 may be longer than the actuation stroke length of the actuator piston 118, a gap may exist between the actuator rod 120 and the engine intake valve 122 when the engine intake valve is lifted a maximum distance from the valve seat 224. When the engine 210 starts its compression stroke, the engine intake valve 122 is urged toward the valve seat 224 by the spring 236. At a desired or determined timing, the directional control valve 134 is closed, thereby locking the actuator piston 118 at its maximum extended position. The locked extension position of the actuator piston 118 may be selected to provide a desired opening for the engine intake valve 122. As the engine intake valve 122 is urged toward the valve seat 224 by the spring 236, the engine intake valve 122 is stopped when it engages the locked actuator piston 118 and is held at this at least partially open position for a desired time.

After a desired retarded timing, the directional control valve 134 may be opened, thereby allowing fluid to flow from the actuator chamber 116 to the tank 126 and releasing the locked actuator piston 118. The spring 236 then urges the intake valve 122 back into engagement with the valve seat 224. Also, the spring 236 urges the actuator piston 118 toward a retracted position via the intake valve 122.

For example, as the actuator piston 118 is initially urged toward a retracted position, fluid in the cavity 242 may flow from the cavity 242 through the first flow passage 250 via the radial passages 270 and the snubbing orifice 246. The check valve 140 blocks fluid flow from the second flow passage 252 and the additional radial passages 272 during retraction of the piston 118. As the actuator piston 118 is retracted, radial passages 270 are eventually blocked by the piston 118, leaving only the snubbing orifice 246 open. Thus, the hydraulic fluid in the cavity 242 can only escape through the snubbing orifice 246. This reduction of flow area by closing the radial passages 270 reduces the closing velocity of the actuator piston 118, which in turn reduces the seating velocity of the engine intake valve 122.

Further, when the actuator rod 120 engages the rocker arm 232 to prevent the intake valve 122 from closing, the force of the spring 236 acting through the rocker arm 232 may cause an increase in the pressure of the fluid within the variable valve assembly 110. In response to the increased pressure, a flow of fluid may be throttled through the restrictive orifice 150 into the accumulator 148. The throttling of the fluid through the restrictive orifice 150 may dissipate energy from the fluid within the variable valve assembly 110.

The restrictive orifice 150 and the accumulator 148 may therefore dissipate energy from the variable valve assembly 110 as fluid flows into and out of the accumulator 148. In this manner, the restrictive orifice 150 and the accumulator 148 may absorb or reduce the impact of pressure fluctuations within the variable valve assembly 110, such as may be caused by the impact of the rocker arm 232 on the actuator rod 120. By absorbing or reducing pressure fluctuations, the restricted orifice 150 and the accumulator 148 may act to inhibit or minimize oscillations in the actuator rod 120.

As will be apparent from the foregoing description, the disclosed engine valve actuation system may include a fluid actuator and a snubbing assembly in a compact arrangement. The snubbing assembly 144 may reduce the closing velocity of the intake valve 122, thus protecting the valve seat 224 from damage. Thus, the disclosed system provides a more compact, less expensive engine valve actuation system 100 that may reduce damage to and increase the useful life of the valve 122 and the valve seat 224.

It will be apparent to those skilled in the art that various modifications and variations can be made in the engine valve actuation system of the present invention without departing from the scope of the invention. Other embodiments of the invention will be apparent to those skilled in the art from consideration of the specification and practice of the invention disclosed herein. It is intended that the specification and examples be considered as exemplary only.

What is claimed is:

1. An engine valve actuation system, comprising:

an engine valve moveable between a first position that blocks a flow of fluid and a second position that allows a flow of fluid;

a valve actuation assembly operably connected to move the engine valve between the first position and the second position;

a separate fluid actuator configured to selectively modify a timing of the engine valve in moving from the second position to the first position, the separate fluid actuator including a cylinder having a longitudinal direction and a piston cooperating to at least partly define a chamber, the piston having at least one fluid passage and being slidably movable in the cylinder between a first position and a second position;

a source of fluid in communication with the separate fluid actuator; and first, second, and third passages longitudinally spaced apart in the cylinder, each of the first, second, and third passages structured and arranged to allow fluid to flow from the source of fluid to the chamber at a time when the piston is moving from the first position to the second position, said piston blocking at least a portion of one of the first, second, and third passages at an intermediate position between the second position and the first position so as to reduce the flow of fluid from the chamber at a time when the piston is moving from the second position toward the first position, the at least one fluid passage of the piston being in communication with at least one of the first, second, and third passages.

2. The engine valve actuation system of claim 1, further including a check valve configured to prevent fluid flow through at least one of the first, second, and third passages during movement of the piston from the second position toward the first position.

3. The engine valve actuation system of claim 1, further including a stop member cooperating with the actuator cylinder to retain at least a portion of the piston in the actuator cylinder.

4. The engine valve actuation system of claim 3, further including a flow path configured to prevent hydraulic lock of the piston.

5. The engine valve actuation system of claim 1, further including an accumulator configured to reduce the impact of pressure fluctuations within the system.

6. The engine valve actuation system of claim 1, further including a fluid rail having a first end and a second end, the fluid rail being configured to supply fluid to the fluid actuator; and a fluid tank in selective fluid communication with the fluid rail.

7. The engine valve actuation system of claim 1, further including a directional control valve configured to control a flow of fluid between the source of fluid and the fluid actuator.

8. The engine valve actuation system of claim 1, wherein the source of fluid provides fluid having a pressure of between about 210 KPa and 620 KPa to the fluid rail.

9. A method of operating an engine valve actuation system, comprising:

moving an engine valve, according to an engine timing, between a first position that blocks a flow of fluid and a second position that allows a flow of fluid;

directing fluid flow from a source of fluid to a chamber of a fluid actuator via first, second, and third longitudinally spaced apart passages in an actuator cylinder to slideably move an actuator piston in the actuator cylinder between a first position and an second position, the actuator piston having at least one passage in fluid communication with at least one of the first, second, and third passages;

operatively engaging the fluid actuator with the engine valve when the piston is in the second position to modify the timing of moving the engine valve from the second position to the first position;

passing fluid from the chamber to the source of fluid at a first rate at a time when the piston is moving from the second position toward the first position; and throttling said passing of fluid from the chamber to a second rate less than the first rate by blocking one of the first, second, and third passages from the chamber with said piston at a time when the piston is moving from the second position toward the first position.

10. The method of claim 9, further including:

preventing fluid flow through at least one other of the first, second, and third passages during at least a portion of movement of the piston from the second position toward the first position.

11. An engine valve actuation system, comprising:

an engine valve moveable between a first position that blocks a flow of fluid and a second position that allows a flow of fluid;

a valve actuation assembly operably connected to move the engine valve between the first position and the second position;

a separate fluid actuator configured to selectively modify a timing of the engine valve in moving from the second position to the first position, the separate fluid actuator including a cylinder having a longitudinal direction, a piston, and a chamber, the cylinder including a snubbing orifice and first, second, and third passages longitudinally spaced apart in the cylinder, the piston having at least one passage in fluid communication with at least one of the first, second, and third passages and being slidably movable in the cylinder between a first position and a second position; and a source of fluid in fluid communication with the separate fluid actuator, the source of fluid being in fluid communication with the chamber via the snubbing orifice and the first, second, and third passages when the piston moves from the first position toward the second position, and fluid flow through at least one of the first, second, and third passages being prevented during at least a portion of movement of the piston from the second position toward the first position.

12. An engine valve actuation system, comprising:

an engine valve moveable between a first position that blocks a flow of fluid and a second position that allows a flow of fluid;

a valve actuation assembly operably connected to move the engine valve between the first position and the second position;

a fluid actuator configured to selectively modify a timing of the engine valve in moving from the second position to the first position, the fluid actuator including a cylinder and a piston cooperating to at least partly define a chamber, the piston being slidably movable in the cylinder between a first position and a second position;

a source of fluid in communication with the fluid actuator;

a pair of passages in the cylinder, said passages structured and arranged to allow fluid to flow from the chamber to the source of fluid at a time when the piston is moving from the second position toward the first position, said piston blocking at least a portion of one of said passages at an intermediate position between the second position and the first position so as to reduce the flow of fluid from the chamber at a time when the piston is moving from the second position toward the first position;

a stop member cooperating with the actuator cylinder to retain at least a portion of the piston in the actuator cylinder; and a flow path configured to prevent hydraulic lock of the piston, wherein the flow path includes at least one flow passage in the stop member in fluid communication with a tank.

13. The engine valve actuation system of claim 12, wherein the cylinder includes at least one additional passage longitudinally spaced from said pair of passages, the source of fluid being in fluid communication with the chamber via the at least one additional passage when the piston moves from the first position toward the second position.

14. The engine valve actuation system of claim 13, further including a check valve configured to prevent fluid flow through the at least one additional passage during movement of the piston from the second position toward the first position.

15. The engine valve actuation system of claim 12, further including an accumulator configured to reduce the impact of pressure fluctuations within the system.

16. The engine valve actuation system of claim 12, further including:

a fluid rail having a first end and a second end, the fluid rail being configured to supply fluid to the fluid actuator; and a fluid tank in selective fluid communication with the fluid rail.

17. The engine valve actuation system of claim 12, further including a directional control valve configured to control a flow of fluid between the source of fluid and the fluid actuator.

18. The engine valve actuation system of claim 12, wherein the source of fluid provides fluid having a pressure of between about 210 KPa and 620 KPa to the fluid rail.

19. An engine valve actuation system, comprising:

an engine valve moveable between a first position that blocks a flow of fluid and a second position that allows a flow of fluid;

a valve actuation assembly operably connected to move the engine valve between the first position and the second position;

a fluid actuator configured to selectively modify a timing of the engine valve in moving from the second position to the first position, the fluid actuator including a cylinder and a piston cooperating to at least partly define a chamber, the piston being slidably movable in the cylinder between a first position and a second position;

a source of fluid in communication with the fluid actuator;

a pair of passages in the cylinder, said passages structured and arranged to allow fluid to flow from the chamber to the source of fluid at a time when the piston is moving from the second position toward the first position, said piston blocking at least a portion of one of said passages at an intermediate position between the second position and the first position so as to reduce the flow of fluid from the chamber at a time when the piston is moving from the second position toward the first position;

an accumulator configured to reduce the impact of pressure fluctuations within the system; and a restrictive orifice associated with the accumulator.

20. The engine valve actuation system of claim 19, wherein the cylinder includes at least one additional passage longitudinally spaced from said pair of passages, the source of fluid being in fluid communication with the chamber via the at least one additional passage when the piston moves from the first position toward the second position.

21. The engine valve actuation system of claim 20, further including a check valve configured to prevent fluid flow through the at least one additional passage during movement of the piston from the second position toward the first position.

22. The engine valve actuation system of claim 19, further including a stop member cooperating with the actuator cylinder to retain at least a portion of the piston in the actuator cylinder.

23. The engine valve actuation system of claim 22, further including a flow path configured to prevent hydraulic lock of the piston.

24. The engine valve actuation system of claim 19, further including an accumulator configured to reduce the impact of pressure fluctuations within the system.

25. The engine valve actuation system of claim 19, further including a directional control valve configured to control a flow of fluid between the source of fluid and the fluid actuator.

26. The engine valve actuation system of claim 19, further including:

a fluid rail having a first end and a second end, the fluid rail being configured to supply fluid to the fluid actuator; and a fluid tank in selective fluid communication with the fluid rail.

27. The engine valve actuation system of claim 26, further including a restrictive orifice disposed between the source of fluid and the fluid rail.

28. The engine valve actuation system of claim 19, wherein the source of fluid provides fluid having a pressure of between about 210 KPa and 620 KPa to the fluid rail.

29. An engine valve actuation system, comprising:

an engine valve moveable between a first position that blocks a flow of fluid and a second position that allows a flow of fluid;

a valve actuation assembly operably connected to move the engine valve between the first position and the second position;

a fluid actuator configured to selectively modify a timing of the engine valve in moving from the second position to the first position, the fluid actuator including a cylinder and a piston cooperating to at least partly define a chamber, the piston being slidably movable in the cylinder between a first position and a second position;

a source of fluid in communication with the fluid actuator;

a pair of passages in the cylinder, said passages structured and arranged to allow fluid to flow from the chamber to the source of fluid at a time when the piston is moving from the second position toward the first position, said piston blocking at least a portion of one of said passages at an intermediate position between the second position and the first position so as to reduce the flow of fluid from the chamber at a time when the piston is moving from the second position toward the first position;

a fluid rail having a first end and a second end, the fluid rail being configured to supply fluid to the fluid actuator;

a fluid tank in selective fluid communication with the fluid rail; and a control valve configured to control a flow of fluid from the fluid rail to the fluid tank, the control valve being moveable between a first position that blocks a flow of fluid from the fluid rail to the fluid tank and a second position that allows a flow of fluid from the fluid rail to the fluid tank.

30. The engine valve actuation system of claim 29, wherein the cylinder includes at least one additional passage longitudinally spaced from said pair of passages, the source of fluid being in fluid communication with the chamber via the at least one additional passage when the piston moves from the first position toward the second position.

31. The engine valve actuation system of claim 30, further including a check valve configured to prevent fluid flow through the at least one additional passage during movement of the piston from the second position toward the first position.

32. The engine valve actuation system of claim 29, further including a stop member cooperating with the actuator cylinder to retain at least a portion of the piston in the actuator cylinder.

33. The engine valve actuation system of claim 32, further including a flow path configured to prevent hydraulic lock of the piston.

34. The engine valve actuation system of claim 29, further including an accumulator configured to reduce the impact of pressure fluctuations within the system.

35. The engine valve actuation system of claim 29, further including a directional control valve configured to control a flow of fluid between the source of fluid and the fluid actuator.

36. The engine valve actuation system of claim 29, further including a restrictive orifice disposed between the source of fluid and the fluid rail.

37. The engine valve actuation system of claim 29, wherein the source of fluid provides fluid having a pressure of between about 210 KPa and 620 KPa to the fluid rail.

38. An engine valve actuation system, comprising:

an engine valve moveable between a first position that blocks a flow of fluid and a second position that allows a flow of fluid;

a valve actuation assembly operably connected to move the engine valve between the first position and the second position;

a fluid actuator configured to selectively modify a timing of the engine valve in moving from the second position to the first position, the fluid actuator including a cylinder and a piston cooperating to at least partly define a chamber, the piston being slidably movable in the cylinder between a first position and a second position;

a source of fluid in communication with the fluid actuator;

a pair of passages in the cylinder, said passages structured and arranged to allow fluid to flow from the chamber to the source of fluid at a time when the piston is moving from the second position toward the first position, said piston blocking at least a portion of one of said passages at an intermediate position between the second position and the first position so as to reduce the flow of fluid from the chamber at a time when the piston is moving from the second position toward the first position;

a fluid rail having a first end and a second end, the fluid rail being configured to supply fluid to the fluid actuator;

a fluid tank in selective fluid communication with the fluid rail; and a restrictive orifice disposed between the source of fluid and the fluid rail.

39. The engine valve actuation system of claim 38, wherein the cylinder includes at least one additional passage longitudinally spaced from said pair of passages, the source of fluid being in fluid communication with the chamber via the at least one additional passage when the piston moves from the first position toward the second position.

40. The engine valve actuation system of claim 39, further including a check valve configured to prevent fluid flow through the at least one additional passage during movement of the piston from the second position toward the first position.

41. The engine valve actuation system of claim 38, further including a stop member cooperating with the actuator cylinder to retain at least a portion of the piston in the actuator cylinder.

42. The engine valve actuation system of claim 41, further including a flow path configured to prevent hydraulic lock of the piston.

43. The engine valve actuation system of claim 38, further including an accumulator configured to reduce the impact of pressure fluctuations within the system.

44. The engine valve actuation system of claim 38, further including a directional control valve configured to control a flow of fluid between the source of fluid and the fluid actuator.

45. The engine valve actuation system of claim 38, wherein the source of fluid provides fluid having a pressure of between about 210 KPa and 620 KPa to the fluid rail.

46. An engine valve actuation system, comprising:

an engine valve moveable between a first position that blocks a flow of fluid and a second position that allows a flow of fluid;

a valve actuation assembly operably connected to move the engine valve between the first position and the second position;

a fluid actuator configured to selectively modify a timing of the engine valve in moving from the second position to the first position, the fluid actuator including a cylinder and a piston cooperating to at least partly define a chamber, the piston being slidably movable in the cylinder between a first position and a second position;

a source of fluid in communication with the fluid actuator;

a pair of passages in the cylinder, said passages structured and arranged to allow fluid to flow from the chamber to the source of fluid at a time when the piston is moving from the second position toward the first position, said piston blocking at least a portion of one of said passages at an intermediate position between the second position and the first position so as to reduce the flow of fluid from the chamber at a time when the piston is moving from the second position toward the first position;

a directional control valve configured to control a flow of fluid between the source of fluid and the fluid actuator; and a check valve, wherein the check valve and the directional control valve are disposed in parallel between the fluid actuator and the source of fluid.

47. The engine valve actuation system of claim 46, wherein the cylinder includes at least one additional passage longitudinally spaced from said pair of passages, the source of fluid being in fluid communication with the chamber via the at least one additional passage when the piston moves from the first position toward the second position.

48. The engine valve actuation system of claim 47, further including a check valve configured to prevent fluid flow through the at least one additional passage during movement of the piston from the second position toward the first position.

49. The engine valve actuation system of claim 46, further including a stop member cooperating with the actuator cylinder to retain at least a portion of the piston in the actuator cylinder.

50. The engine valve actuation system of claim 49, further including a flow path configured to prevent hydraulic lock of the piston.

51. The engine valve actuation system of claim 46, further including an accumulator configured to reduce the impact of pressure fluctuations within the system.

52. The engine valve actuation system of claim 46, further including a fluid rail having a first end and a second end, the fluid rail being configured to supply fluid to the fluid actuator; and a fluid tank in selective fluid communication with the fluid rail.

53. The engine valve actuation system of claim 52, further including a directional control valve configured to control a flow of fluid between the source of fluid and the fluid actuator.

54. The engine valve actuation system of claim 46, further including an air bleed valve disposed between the check valve and the fluid actuator.

55. The engine valve actuation system of claim 46, wherein the source of fluid provides fluid having a pressure of between about 210 KPa and 620 KPa to the fluid rail.

56. A method of operating an engine valve actuation system, comprising:

moving an engine valve, according to an engine timing, between a first position that blocks a flow of fluid and a second position that allows a flow of fluid;

directing fluid flow between a source of fluid and a chamber of a fluid actuator to slideably move an actuator piston in an actuator cylinder between a first position and an second position;

operatively engaging the fluid actuator with the engine valve when the piston is in the second position to modify the timing of moving the engine valve from the second position to the first position;

passing fluid from the chamber to the source of fluid at a first rate at a time when the piston is moving from the second position toward the first position;

throttling said passing of fluid from the chamber to a second rate less than the first rate by blocking a fluid passage from the chamber with said piston at a time when the piston is moving from the second position toward the first position; and retaining at least a portion of the actuator piston in the actuator cylinder with a stop member coupled with the actuator cylinder, the stop member defining at least a portion of a flow path configured to prevent hydraulic lock of the actuator piston.

57. The method of claim 56, further including:

allowing fluid flow from the source of fluid to the chamber via at least one additional passage longitudinally spaced from said fluid passage when the piston moves from the first position toward the second position; and preventing fluid flow through the at least one additional passage during at least a portion of movement of the piston from the second position toward the first position.

58. A method of operating an engine valve actuation system, comprising:

moving an engine valve, according to an engine timing, between a first position that blocks a flow of fluid and a second position that allows a flow of fluid;

directing fluid flow between a source of fluid and a chamber of a fluid actuator to slideably move an actuator piston in an actuator cylinder between a first position and an second position;

operatively engaging the fluid actuator with the engine valve when the piston is in the second position to modify the timing of moving the engine valve from the second position to the first position;

passing fluid from the chamber to the source of fluid at a first rate at a time when the piston is moving from the second position toward the first position;

throttling said passing of fluid from the chamber to a second rate less than the first rate by blocking a fluid passage from the chamber with said piston at a time when the piston is moving from the second position toward the first position; and reducing the impact of pressure fluctuations within the system with at least one of an accumulator and a restrictive orifice.

59. The method of claim 58, further including:

allowing fluid flow from the source of fluid to the chamber via at least one additional passage longitudinally spaced from said fluid passage when the piston moves from the first position toward the second position; and preventing fluid flow through the at least one additional passage during at least a portion of movement of the piston from the second position toward the first position.

* * * * *